US010957993B2

(12) United States Patent
Wu et al.

(10) Patent No.: US 10,957,993 B2
(45) Date of Patent: Mar. 23, 2021

(54) CONNECTOR STRUCTURE

(71) Applicants: SWITCHLAB INC., New Taipei (TW); SWITCHLAB (SHANGHAI) CO., LTD., Shanghai (CN); GAOCHENG ELECTRONICS CO., LTD., Shenzhen (CN)

(72) Inventors: Chih-Yuan Wu, New Taipei (TW); Chih-Kun Hsiao, New Taipei (TW)

(73) Assignees: Switchlab Inc., New Taipei (TW); Switchlab (Shanghai) Co., Ltd., Shanghai (CN); Gaocheng Electronics Co., Ltd., Shenzhen (CN)

( * ) Notice: Subject to any disclaimer, the term of this patent is extended or adjusted under 35 U.S.C. 154(b) by 0 days.

(21) Appl. No.: 16/567,394

(22) Filed: Sep. 11, 2019

(65) Prior Publication Data

US 2020/0091628 A1 Mar. 19, 2020

(30) Foreign Application Priority Data

Sep. 13, 2018 (TW) ..... 107132840 A

(51) Int. Cl.
*H01R 4/48* (2006.01)
*H01R 13/502* (2006.01)

(52) U.S. Cl.
CPC ..... *H01R 4/4836* (2013.01); *H01R 4/4827* (2013.01); *H01R 13/502* (2013.01); *H01R 4/4818* (2013.01)

(58) Field of Classification Search
CPC ..... H01R 4/4818; H01R 4/4836
See application file for complete search history.

(56) References Cited

U.S. PATENT DOCUMENTS 4,780,097 A * 10/1988 Piscitelli ..... H01R 13/187 29/510
5,496,968 A * 3/1996 Katoh ..... H01R 4/183 174/19
6,176,716 B1 * 1/2001 Mercurio ..... H01R 11/12 439/166
6,851,967 B2 * 2/2005 Miyoshi ..... H01R 4/4836 439/441
7,114,986 B1 * 10/2006 Toly ..... H01R 4/4836 439/441
8,251,738 B2 * 8/2012 Heckert ..... H01R 4/4836 439/441
8,480,424 B2 * 7/2013 Koellmann ..... H01R 4/4845 439/358
9,093,762 B2 * 7/2015 Schwarzkopf ..... H01R 4/4836
(Continued)

*Primary Examiner* — Tho D Ta
(74) *Attorney, Agent, or Firm* — Rosenberg, Klein & Lee

(57) ABSTRACT

A connector structure includes a case seat assembly and plug assemblies. Two ends of the case seat assembly are formed with channels. Each plug assembly has a conductive section and a wire connection member. The wire connection member is formed with a receiving space for receiving a pressing leaf spring. Each pressing leaf spring has an abutment end. A lateral protrusion section is disposed on the abutment end. Multiple unlocking assemblies are disposed beside the wire connection member. Each unlocking assembly has a push member formed with a push block. The lateral protrusion section is positioned in a sliding path of the push block along the channel, whereby the lateral protrusion section can be pushed to drive the abutment end to release a conductive wire.

31 Claims, 11 Drawing Sheets

(56) References Cited

U.S. PATENT DOCUMENTS

| | | | | |
|---|---|---|---|---|
| 2004/0152355 | A1* | 8/2004 | Rudy | H01R 4/4836<br>439/438 |
| 2007/0238303 | A1* | 10/2007 | Walter | H01R 4/4836<br>438/709 |
| 2011/0207372 | A1* | 8/2011 | Breen, IV | H01R 12/721<br>439/629 |
| 2012/0052736 | A1* | 3/2012 | Fukushi | H01R 4/4836<br>439/626 |

* cited by examiner

CONNECTOR STRUCTURE

BACKGROUND OF THE INVENTION

1. Field of the Invention

The present invention relates generally to a connector structure, and more particularly to a connector structure, which can reduce material consumption and diversify the use.

2. Description of the Related Art

In the field of connectors mated and connected with each other, it is a critical issue how to easily assemble and connect the connector with the conductive wire and keep the conductive wire securely connected with the connector without loosening after assembled.

For example, a prior art discloses a plug-type connector including a contact carrier component. Multiple contacts are disposed in the contact carrier component corresponding to hollow cylindrical cases arranged in different positions. Each contact includes a conductor connect ion holder, a plug and a flexible connect ion member connected between the conductor connection holder and the plug. A stranded wire can be inserted into the conductor connection holder and secured therein. The plug can extend into the hollow cylindrical case. According to such structure, when the contact bears an excessively great external force, the conductor connection holder can move relative to the plug, whereby the flexible connection member can absorb and compensate the length difference between the stranded wires. Also, the conductor connection holder can be displaced in height (in longitudinal direction) and in transverse direction so as to compensate the angular deflection.

In such structure, a connection member with a fixed length is connected between the conductor connection holder and the plug. Therefore, when the conductor connection holder and the plug are transversely displaced and positioned at different centers, the connection member will deflect to different extents. The deflection of the connection member will lead to change of the longitudinal interval between the conductor connection holder and the plug. In practice, when the positions of the respective plugs of the connector are fixed, the positions of different conductor connection holders will change the plug-in depth of the stranded wire. This will directly affect the security of the stranded wire connected and located in the conductor connection holder.

Furthermore, in the case that the conductor connection holder, the plug and the connection member are an integrally formed structure, the total size of the stretched material will be larger. As a result, more waste material will be produced to cause waste. In addition, the commonness (use range) of both the product and semi-product is limited. In the case that the connection member is welded between the conductor connection holder and the plug, the labor cost will be inevitably increased. Moreover, the material of the connection member must be a special metal plate material with high elasticity and high electro-conductivity. This directly leads to increase of cost.

Another prior art discloses a spring connector, in which multiple axially extending channels are formed on the circumference of one end of the case of a circular connector. An outward turnable rotary lever is pivotally disposed on one side of each channel in adjacency to the middle of the case. A connection unit is disposed in each channel. The connection unit is connected to a connection insertion pin via a conductive connection section. The connection insertion pin extends to the other end of the case. The connection unit has a receiving space defined between two opposite sidewalls. An opening is formed at the top end of the receiving space for the conductive wire to extend therein. A conductive rail inward extends from the opening. One side of the receiving space is directed to the outer circumference of the case and has a hollow for receiving a contact leaf spring. When the rotary lever is inward closed, the rotary lever presses the contact leaf spring, whereby one end of the contact leaf spring abuts against the conductive wire. Accordingly, the conductive wire can keep in tight contact with the conductive rail without loosening in reverse direction. When the rotary lever is outward opened, the contact leaf spring is released to disengage from the conductive wire, whereby the conductive wire can be easily extracted out of the opening.

In the above structure, the connection section connected between the connection unit and the connection insertion pin has a fixed length. Therefore, due to the same factor, the security of the conductive wire connected and located in the connection unit will be affected as aforesaid. Therefore, there are still the problem that the labor cost and manufacturing cost are increased.

In practice, according to the above prior art, no matter whether the conductive wire is plugged into the connector or the conductive wire is extracted out of the connector, it is necessary to turn the rotary lever outward so as to keep the contact leaf spring loosened. This leads to inconvenience in operation and use. Also, due to the limitation of the material and size, the connection strength between the rotary lever and the case is poor. Therefore, due to wear or improper use, the rotary lever is apt to loosen or damage. As a result, the rotary lever can hardly effectively push the contact leaf spring.

It is therefore tried by the applicant to provide an improved connector structure to solve the above problems of the conventional connector structure.

SUMMARY OF THE INVENTION

It is therefore a primary object of the present invention to provide a connector structure including a case seat assembly and multiple plug assemblies arranged in the case seat assembly in a predetermined form. Each plug assembly has a conductive section and a wire connection member. One end of the conductive section is connected with a reception member via a flexible connection section. A conductive wire can be extended from outer side into one side of the wire connection member to be received and engaged therein. The other side of the wire connection member is partially inserted in the reception member and connected therewith. The plug assembly is composed of the conductive section and the wire connection member connected with each other. According to such design, the size of the stretched material of the respective components can be effectively minified and the waste material can be reduced. In addition, in precondition that the wire connection member is commonly used, it is only necessary to replace different specifications of conductive sections, (which can be male end conductive protruding pin or female end conductive socket) to be applied to various same sort of connector products with different specifications. Therefore, the use of the connector is widely diversified to enhance the economic profit of the product.

It is a further object of the present invention to provide the above connector structure, in which a pressing leaf spring is disposed in each wire connection member. The pressing leaf spring has an abutment end. The conductive wire can be extended into the abutment end, whereby the abutment end can abut against and locate the conductive wire. A lateral protrusion section is disposed on one side of the abutment end. An unlocking assembly is disposed beside each wire connection member. Each unlocking assembly has a push member and an elastic member applying elastic force to the push member. The push member is formed with a push block on one side directed to the wire connection member. The lateral protrusion section of the pressing leaf spring is right positioned in a moving path of the push block. Accordingly, in the state that the conductive wire is engaged and located by the pressing leaf spring. The push member can be pushed to drive the push block to push the lateral protrusion section so that the conductive wire can be released and disengaged from the abutment end of the pressing leaf spring and extracted out of the connector. Such design has better structural strength. Moreover, the operation of the respective components is simplified and accurate. Also, the connector can be very conveniently operated.

To achieve the above and other objects, the connector structure of the present invention includes a case seat assembly, a plug assembly, a pressing leaf spring and an unlocking assembly. At least one axially extending channel is formed on a circumference of an end section of the case seat assembly. The plug assembly has a conductive section and a wire connection member electrically connected with each other. A receiving space is disposed at one end of the wire connection member distal from the conductive section. The pressing leaf spring is disposed in the receiving space. One end of the pressing leaf spring is formed with an abutment end obliquely extending in the receiving space for abutting against a conductive wire extending into the receiving space. The unlocking assembly is disposed beside the wire connection member. The unlocking assembly has a push member partially protruding out of the channel. The push member is formed with a push block directed to the interior of the channel. A part of the pressing leaf spring is right positioned in a sliding path of the push block along the channel, whereby the part of the pressing leaf spring can be pushed by the push block to drive the abutment end to release the conductive wire.

In the above connector structure, one end of the conductive section is connected with a reception section via a flexible connection section. The reception section has a reception hole. The wire connection member has a plug protrusion section. The plug protrusion section can be inserted in the reception hole so as to connect the conductive section and the wire connection member with each other.

In the above connector structure, the conductive section is at least one of a conductive socket and a conductive pin.

In the above connector structure, the receiving space has an opening. Two lateral notches are respectively disposed on two sides of the opening. A locating hollow is disposed in one side of the receiving space in adjacency to the conductive section. Two lateral recesses are respectively disposed on two sides of the locating hollow. The pressing leaf spring has a fixed end distal from the abutment end. Two outward protruding lateral protrusions are disposed on two sides of the fixed end. A lateral rib is disposed at the middle of each of two sides of the pressing leaf spring. The fixed end is inserted in the locating hollow of the wire connection member and the two lateral protrusions being inserted in the lateral recesses. The lateral ribs are cooperatively engaged in the lateral notches, whereby the pressing leaf spring is located in the receiving space and the abutment end obliquely extends in a direction away from the opening.

In the above connector structure, a lateral protrusion section is disposed on one side of the abutment end and extends out of the receiving space. The lateral protrusion section has an arched face raised toward the push block. The push block has a trough section on one side corresponding to the lateral protrusion section, whereby when the push block is moved to the position of the lateral protrusion section. By means of the elastic force of the pressing leaf spring, the arched face abuts against the trough section and is located therein In the above connector structure, the case seat assembly is composed of a first case seat and a second case seat connected with each other. The channels are formed on outer circumference of the first case seat. A cavity and an end recess are respectively formed on two end faces of the second case seat. The end recess is directed to the first case seat and communicating with the channels. Multiple passages are formed between the cavity and the end recess. The conductive sections are disposed in the passages. One end of the conductive section extends into the cavity.

In the above connector structure, multiple stop sections are disposed at one end of the first case seat distal from the second case seat and extend into the channels respectively so as to limit the sliding range of the push block within the channel. Each of the stop sections is formed with a wire socket and a notch corresponding to the channel. The wire socket is for the conductive wire to extend into the channel from outer side. A flat tool is usable to pass through the notch from outer side to push the push block to move.

In the above connector structure, multiple lateral sink sections are formed on an end face of the second case seat in adjacency to the first case seat. A locating dent is formed in each lateral sink section. Multiple lateral protrusion sections are formed on an end face of the first case seat in adjacency to the second case seat corresponding to the lateral sink sections. A locating key is disposed on each lateral protrusion section, whereby the lateral protrusion section can be inserted into the corresponding lateral sink section with the locating key inserted in the locating dent so as to securely connect the first and second case seats with each other.

In the above connector structure, a protrusion section is disposed at one end of the second case seat distal from the cavity beside each passage. The protrusion section is inserted into one end of the reception hole distal from the wire connection member. A protruding press section is disposed at a center of the first case seat. The press section serves to press an end face of each conductive section in adjacency to the wire connection member, whereby the conductive section can be securely located in the passage.

In the above connector structure, an elastic member is disposed in each channel beside the push block to abut against the push block. The push member has a protrusion pin section inserted in the elastic member and located therein.

The present invention can be best understood through the following description and accompanying drawings, wherein:

DETAILED DESCRIPTION OF THE PREFERRED EMBODIMENTS

Figure 1:
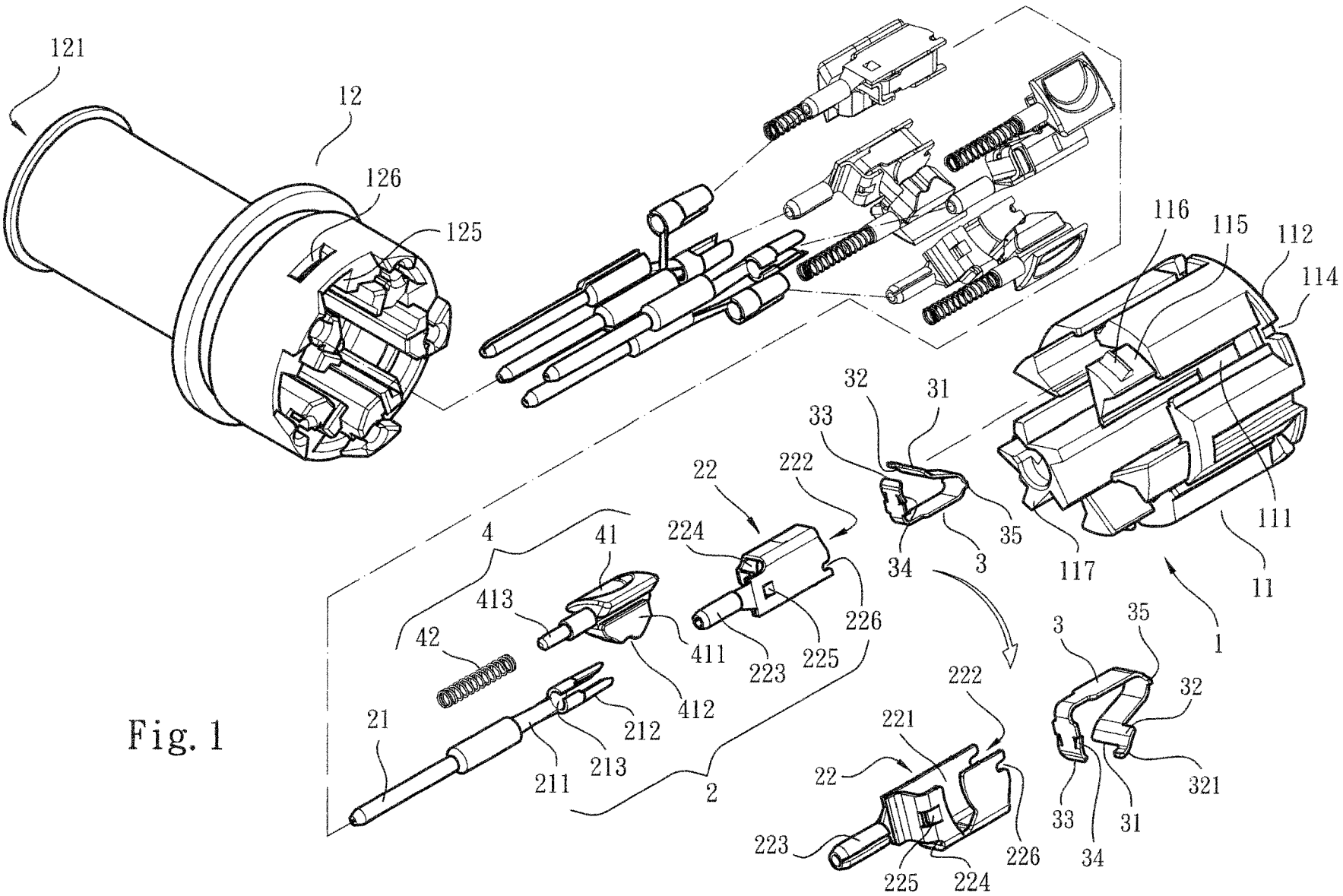
FIG. 1 is a perspective exploded view of the present invention.
Figure 2:
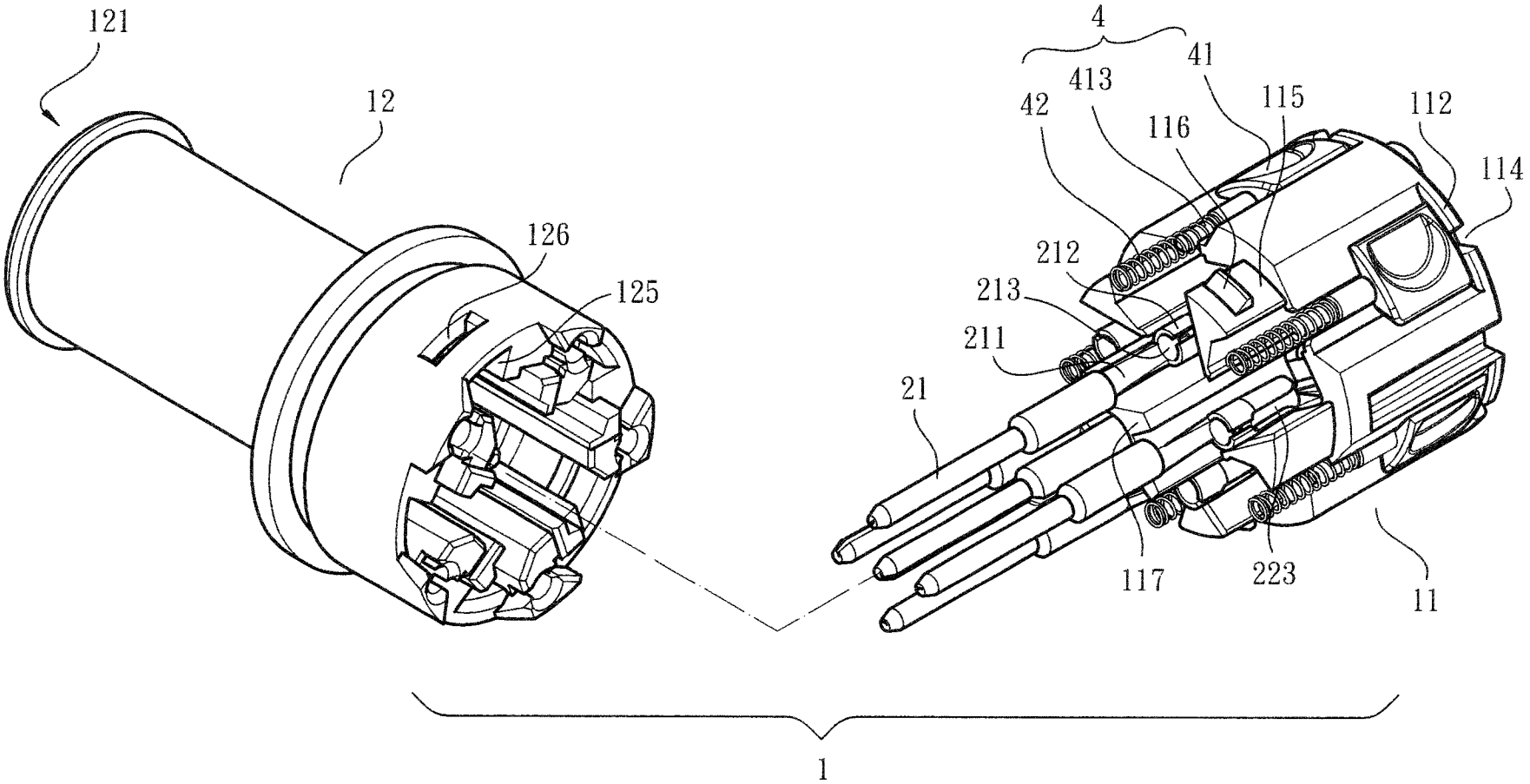
FIG. 2 is a perspective partially assembled view of the present invention.
Figure 3:
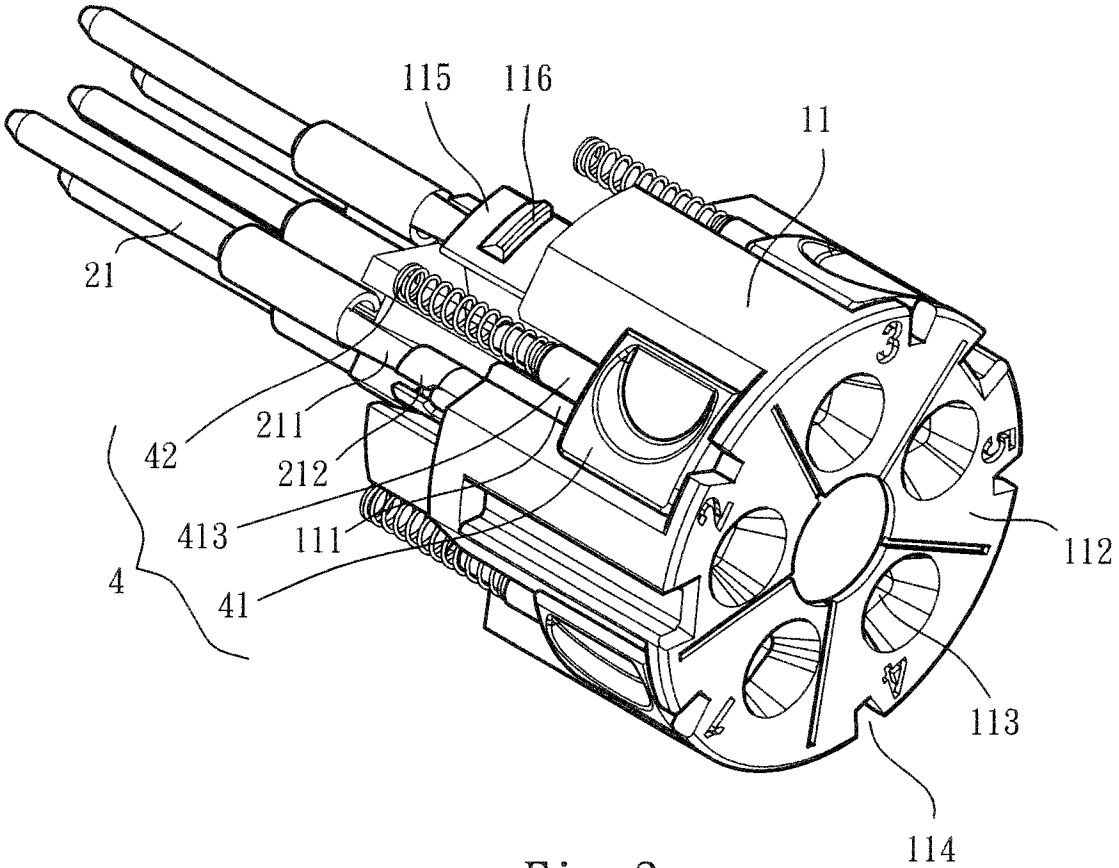
FIG. 3 is a rear perspective partially assembled view of the present invention, showing the first case seat and the relevant components.
Figure 4:
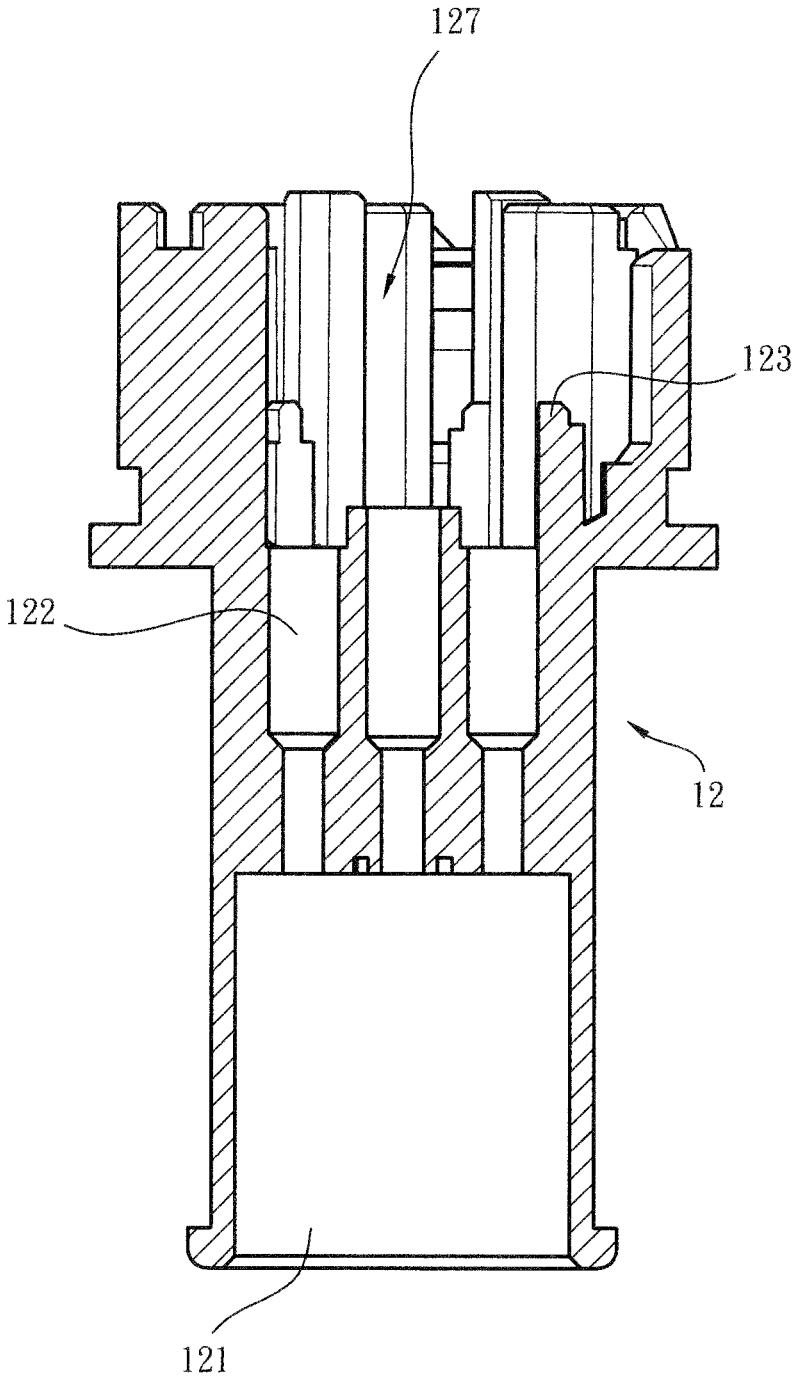
FIG. 4 is a side sectional view of the second case seat of the present invention.
Figure 5:
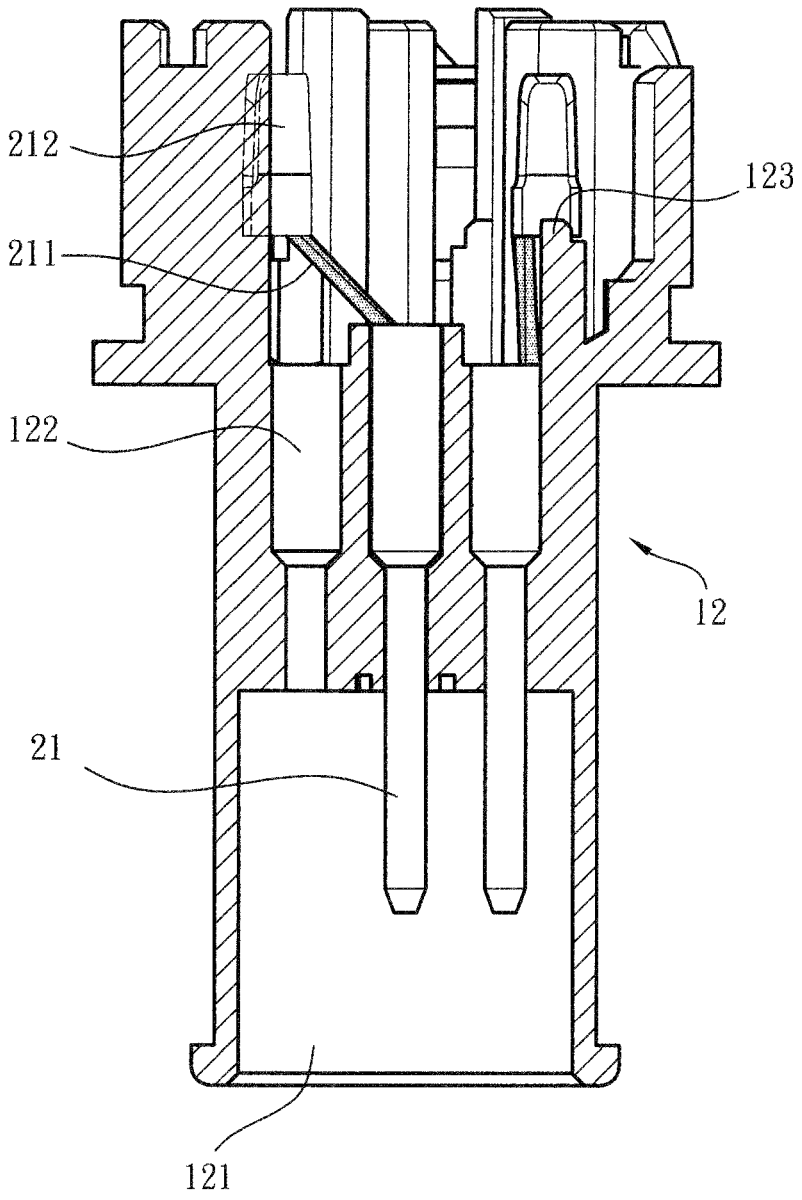
FIG. 5 is a side sectional view of the second case seat of the present invention, showing that some conductive sections are assembled and disposed in the second case seat.
Figure 6:
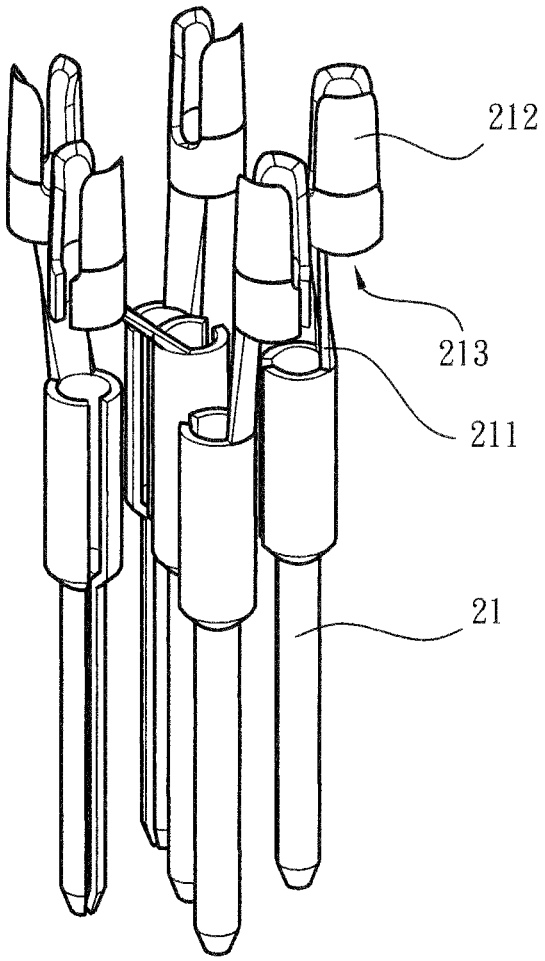
FIG. 6 is a perspective view of the conductive sections of the present invention, showing the relative assembling positions of the conductive sections.
Figure 7:
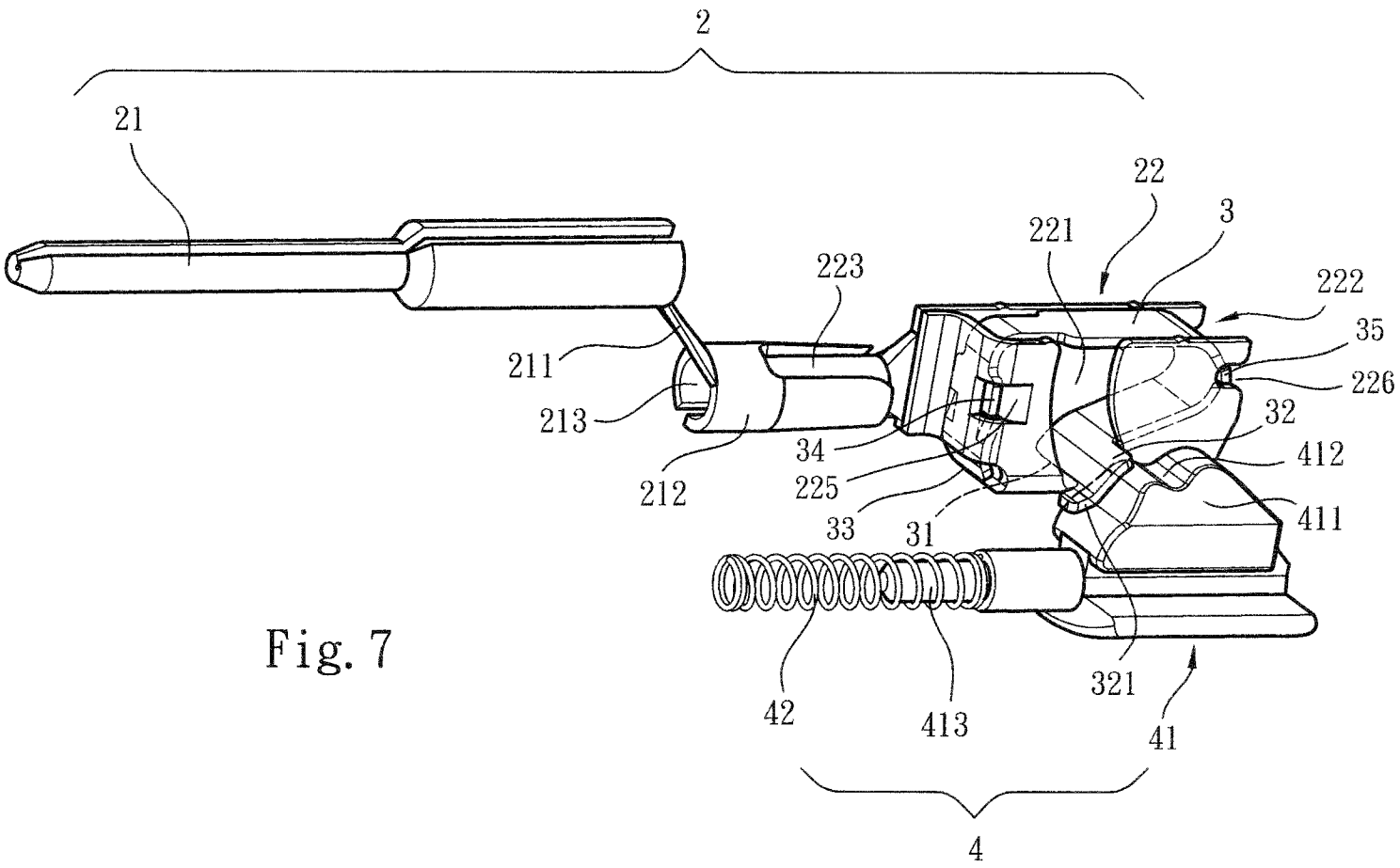
FIG. 7 is a perspective view showing the relative assembling positions of the plug assembly and the unlocking assembly of the present invention.

Please refer to FIGS. 1 to 7. The connector structure of the present invention includes a case seat assembly 1, a plug assembly 2, a pressing leaf spring 3 and an unlocking assembly 4. The case seat assembly 1 includes a first case seat 11 and a second case seat 12 connected with each other. Multiple inward recessed channels 111 are formed on outer circumference of the first case seat 11 and axially extend. Multiple lateral protrusion sections 115 are disposed at one end of the first case seat 11 in adjacency to the second case seat 12.

In a preferred embodiment, multiple stop sections 112 are disposed at one end of the first case seat 11 distal from the second case seat 12 and extend into the channels 111 respectively. Each of the stop sections 112 is formed with a wire socket 113 and a notch 114 corresponding to the channel 111.

A cavity 121 and an end recess 127 are respectively formed on two opposite end faces of the second case seat 12. Multiple passages 122 are formed between the cavity 121 and the end recess 127. In addition, multiple lateral sink sections 125 are formed on inner circumference of the end recess 127 corresponding to the lateral protrusion sections 115. The lateral protrusion sections 115 are inserted in the lateral sink sections 125 so as to connect the first and second case seats 11, 12 with each other.

In a preferred embodiment, a locating dent 126 are formed on each lateral sink section 125 and a locating key 116 is disposed on each lateral protrusion section 115 corresponding to the locating dent 126. Accordingly, the locating key 116 can be inserted into the locating dent 126 to securely connect the first and second case seats 11, 12 with each other. In addition, the passages 122 can communicate with the channels 111 via the end recess 127.

Each plug assembly 2 has a conductive section 21 and a wire connection member 22. (In this embodiment, the conductive section 21 is a conductive pin applicable to a male plug). The conductive sections 21 are respectively disposed in the passages 122. One end of the conductive section 21 partially extends into the cavity 121. The other end of the conductive section 21 is connected with a reception section 212 via a flexible connection section 211. The reception section 212 has a reception hole 213. The wire connection members 22 are respectively received in the channels 111. Two ends of the wire connection member 22 are respectively formed with a plug protrusion section 223 and a receiving space 221. The plug protrusion section 223 is inserted in the reception hole 213 and connected therewith. The receiving space 221 has an opening 222 directed to the wire socket 113. Two lateral notches 226 are respectively disposed on two sides of the opening 222. A locating hollow 224 is disposed in one side of the receiving space 221 in adjacency to the plug protrusion section 223. Two lateral recesses 225 are respectively disposed on two sides of the locating hollow 224.

In practice, according to general specification, the multiple passages 122 of the second case seat 12 can include a passage 122 in alignment with the center of the cavity 121, while the other passages 122 are uniformly distributed around the central passage 122. The wire connection members 22 are received in the channels 111. Therefore, in comparison with the surrounding passages 122, the central passage 122 has larger transverse deflection distance. In order to absorb the transverse deflection distance, in design, the length of the connection section 211 or the reception section 212 of the conductive section 21 mounted in the central passage 122 is increased to solve the problem. Accordingly, the conductive wire A and the wire connection member 22 can keep a sufficient contact area therebetween.

In a preferred embodiment, a protrusion section 123 is disposed in each end recess 127 corresponding to a lateral side of the passage 122. The protrusion section 123 is inserted into one end of the reception hole 213 distal from the wire connection member 22. In addition, a protruding press section 117 is disposed at the center of one side of the first case seat 11 in adjacency to the second case seat 12. The press section 117 serves to press an end face of the conductive section 21 in adjacency to the wire connection member 22, whereby the conductive section 21 can be securely located in the passage 122.

Multiple pressing leaf springs 3 are respectively disposed in the receiving spaces 221 of the wire connection members 22. Two ends of each pressing leaf spring 3 are respectively formed with a fixed end 33 and an abutment end 31. Two outward protruding lateral protrusions 34 are disposed on two sides of the fixed end 33. In addition, a lateral rib 35 is disposed at the middle of each of two sides of the pressing leaf spring 3. The fixed end 33 is inserted in the locating hollow 224 of the wire connection member 22 and the two lateral protrusions 34 are inserted in the lateral recesses 225. The lateral ribs 35 are cooperatively engaged in the lateral notches 226, whereby the pressing leaf spring 3 is located in the receiving space 221. The abutment end 31 obliquely extends in a direction away from the opening 222. According to the above structure, the moving path of the abutment end 31 is limited. Also, the pressing leaf spring 3 is securely located in the receiving space 221 of the wire connection member 22. In addition, a lateral protrusion section 32 is disposed on one side of the abutment end 31 of the pressing leaf spring 3 and extends out of the receiving space 221. A raised arched face 321 is formed on the lateral protrusion section 32.

Multiple unlocking assemblies 4 are respectively disposed beside the wire connection members 22. Each unlocking assembly 4 is composed of a push member 41 and an elastic member 42 applying an elastic force to the push member 41. The push member 41 partially protrudes out of the channel 111. A push block 411 is disposed on one side of the pushmember 41 directed to the interior of the channel 111. The stop section 112 and the two ends of the second case seat 12 in the channel 111 can limit the sliding range of the push block 411. A trough section 412 is disposed on one side of the push block 411 corresponding to the lateral protrusion section 32, whereby the lateral protrusion section 32 is right positioned in the sliding path of the push block 411 along the channel 111.

In practice, a finger can directly press the push member 41 to move. Alternatively, a flat tool (such as a screwdriver) can be used to extend from outer side through the notch 114 to push the push block 411 so as to drive the push member 41 to move.

In a preferred embodiment, the elastic member 42 is a spring disposed in the channel 111 on one side in adjacency to the second case seat 12. The push member 41 has a protrusion pin section 413 inserted in one end of the elastic member 42 and located therein.

Figure 8:
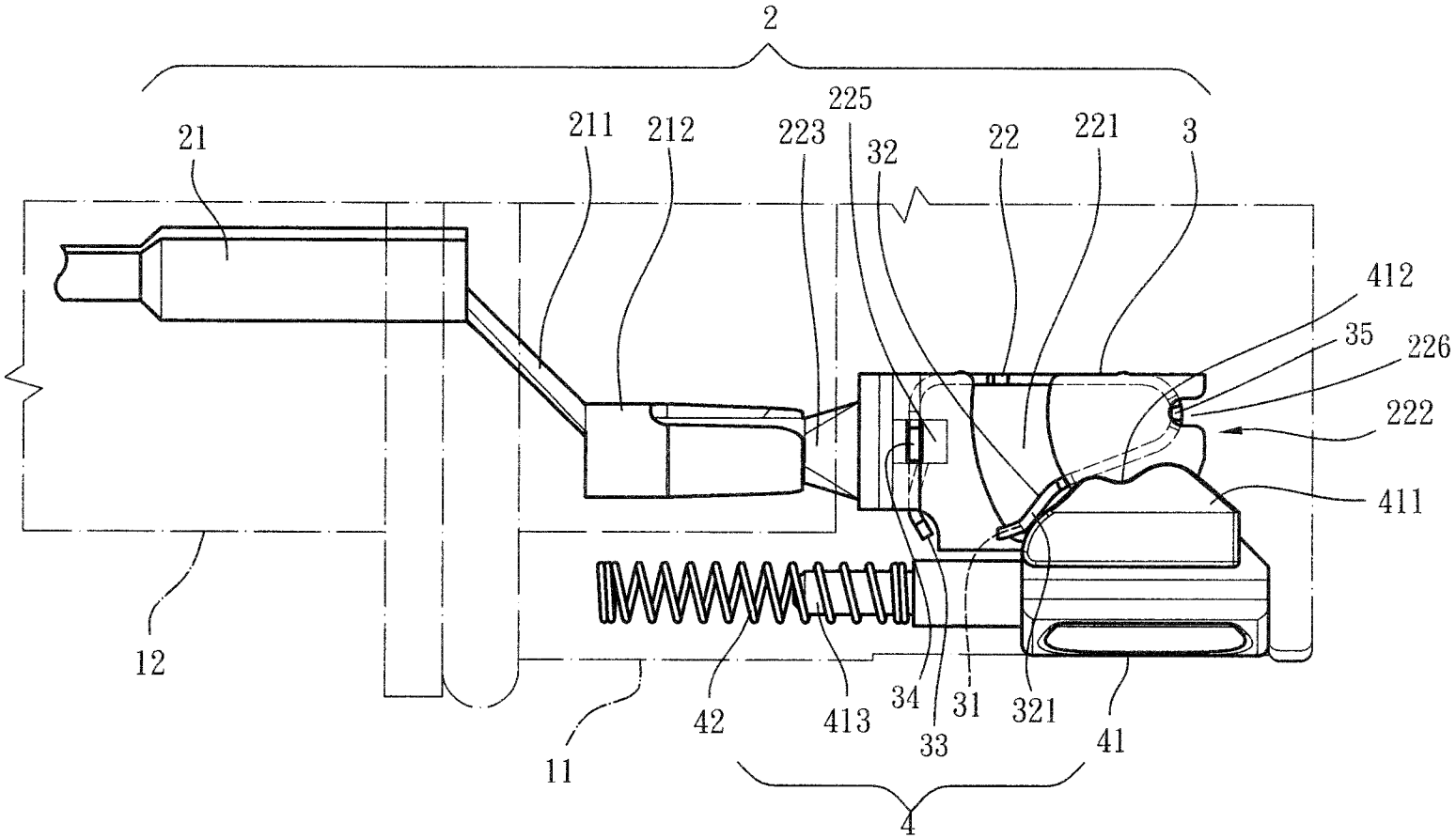
FIG. 8 is a side view showing the position of the unlocking assembly of the present invention, in which the unlocking assembly is not operated.
Figure 9:
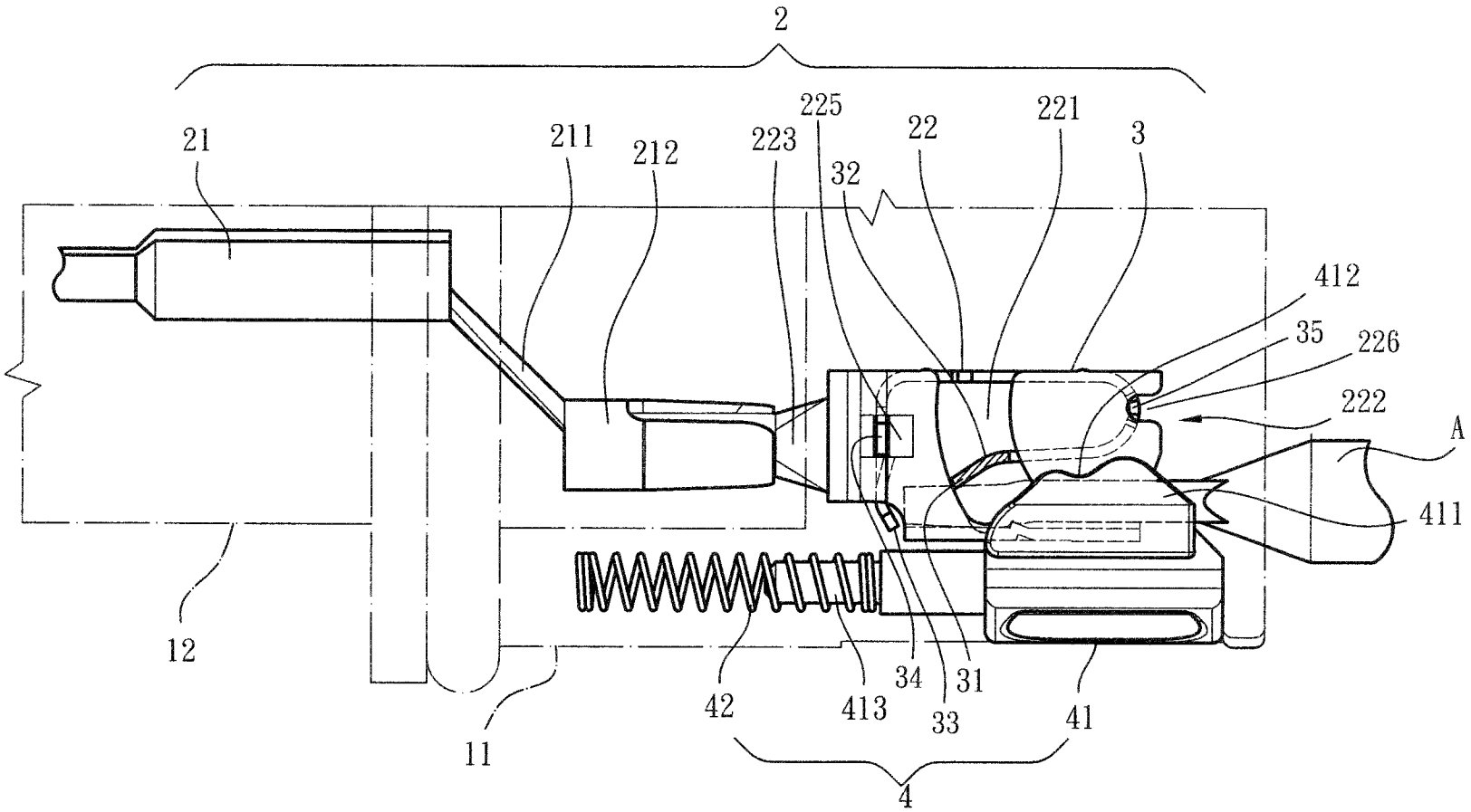
FIG. 9 is a side view showing that the conductive wire is plugged into the wire connection member and engaged and located therein.
Figure 10:
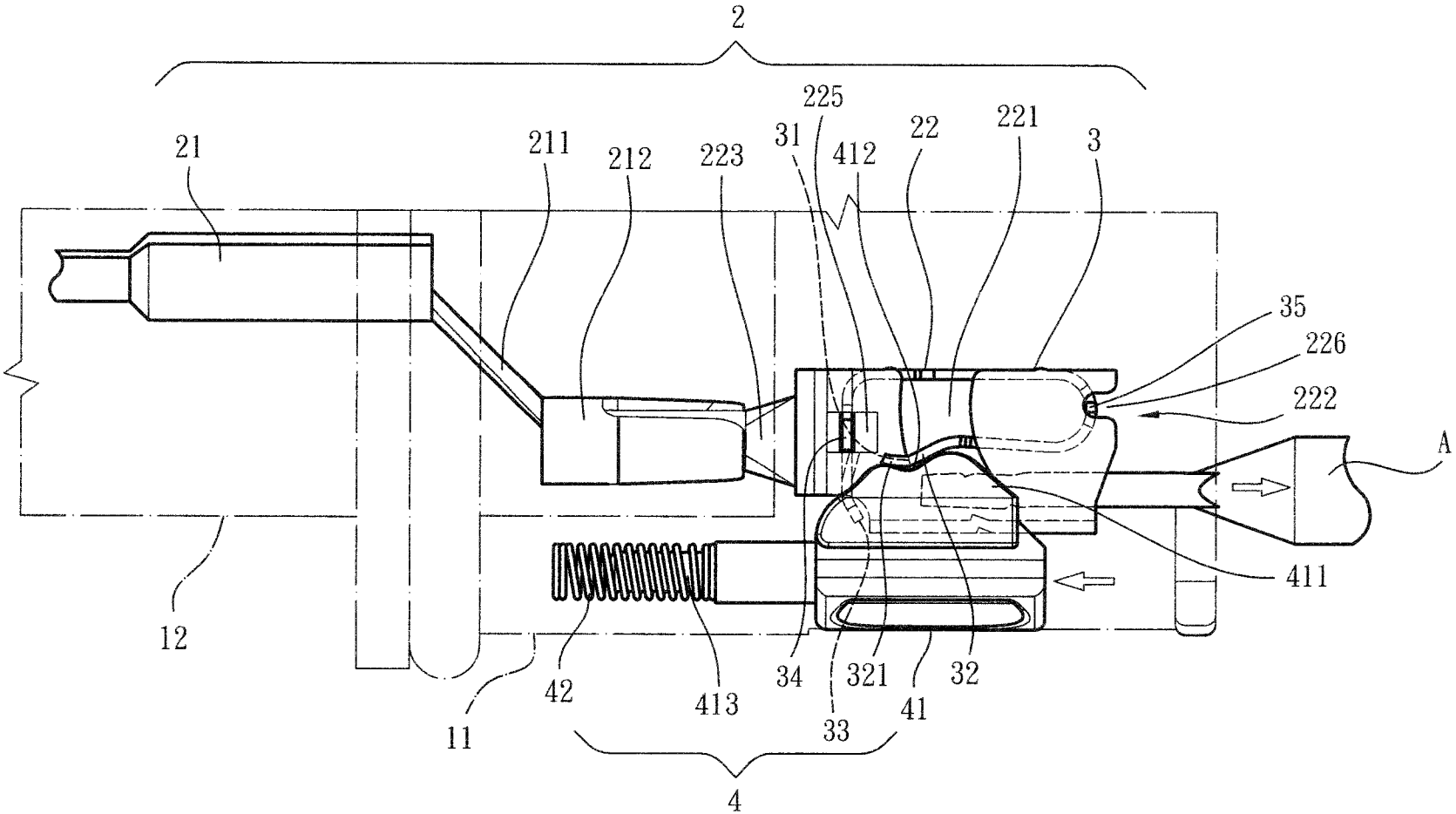
FIG. 10 is a side view showing that the unlocking assembly of the present invention is operated to release the conductive wire from the wire connection member.

Please refer to FIGS. 8 to 10. In use of the present invention, in the state that the conductive wire A is not connected, the push block 411 is positioned beside the lateral protrusion section 32 of the pressing leaf spring 3 (as shown in FIG. 8). When the conductive wire A extends from the outer side through the wire socket 113 into the channel 111, the conductive wire A can pass through the opening 222 and insert into the receiving space 221 to push the abutment end 31 of the pressing leaf spring 3. The pressing leaf spring 3 is elastically extensible so that the abutment end 31 can abut against the conductive wire A after the conductive wire A passes through. In this case, the conductive wire A cannot be extracted out (as shown in FIG. 9).

When it is desired to detach the conductive wire A, the push member 41 is pushed (to compress the elastic member 42), whereby the push block 411 is driven to pass through the lateral protrusion section 32. By means of the elastic force of the pressing leaf spring 3, the arched face 321 abuts against the inner side of the trough section 412, whereby the push block 411 is located. At this time, the abutment end 31 of the pressing leaf spring 3 is pushed by the push block 411 to separate from the surface of the conductive wire A (as shown in FIG. 10). Under such circumstance, the conductive wire A is disengaged and can be extracted outward. In case the push member 41 is pushed in a reverse direction, under the elastic force of the elastic member 42, the push member 41 is restored to its home position.

Figure 11:
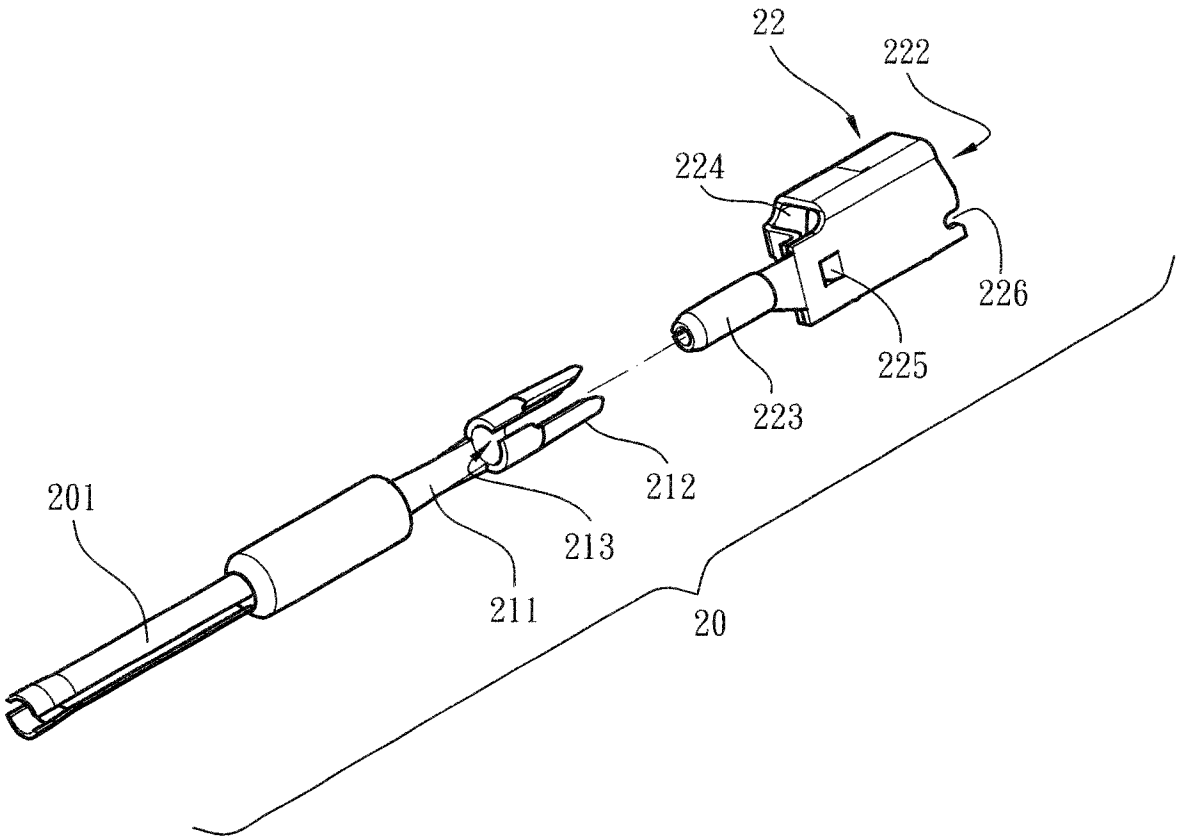
FIG. 11 is a perspective view of another embodiment of the plug assembly of the present invention.

Please refer to FIG. 11. According to another embodiment of the present invention, the plug assembly 20 includes a conductive section 201 and a reception member 22 identical to the above embodiment. An end face of the conductive section 201 is formed with a conductive socket, in which the aforesaid conductive section 21 (conductive pin) can extend and connect. The other end of the conductive section 201 is also connected with a reception section 212 via a flexible connection section 211. The reception section 212 has a reception hole 213. The plug protrusion section 223 of the wire connection member 22 can be inserted in the reception hole 213 to connect therewith. Accordingly, the plug assembly 20 has a plug structure applicable to a female socket.

The above embodiments are only used to illustrate the present invention, not intended to limit the scope thereof. Many modifications of the above embodiments can be made without departing from the spirit of the present invention.

What is claimed is:

1. A connector structure comprising a case seat assembly, a plug assembly, a pressing leaf spring and an unlocking assembly, at least one axially extending channel being formed on a circumference of an end section of the case seat assembly, the plug assembly having a conductive section and a wire connection member electrically connected with each other, a receiving space being disposed at one end of the wire connection member distal from the conductive section, the pressing leaf spring being disposed in the receiving space, one end of the pressing leaf spring terminating at an abutment end obliquely extending in the receiving space for abutting against a conductive wire extending into the receiving space, the unlocking assembly being disposed beside the wire connection member, the unlocking assembly having a push member partially protruding out of the channel, the push member being formed with a push block directed to the interior of the channel, a part of the pressing leaf spring extending from the abutment end into a sliding path of the push block along the channel, the sliding path being transversely offset from the receiving space, the part of the pressing leaf spring is pushed by the push block upon displacement thereof to drive the abutment end to release the conductive wire.

2. The connector structure as claimed in claim 1, wherein an elastic member is disposed in each channel beside the push block to abut against the push block, the push member having a protrusion pin section inserted in the elastic member and located therein.

3. The connector structure as claimed in claim 1, wherein one end of the conductive section is connected with a reception section via a flexible connection section, the reception section having a reception hole, the wire connection member having a plug protrusion section, the plug protrusion section being insertable in the reception hole so as to connect the conductive section and the wire connection member with each other.

4. The connector structure as claimed in claim 3, wherein a lateral protrusion section is disposed on one side of the abutment end and extends out of the receiving space, the lateral protrusion section having an arched face raised toward the push block, the push block having a trough section on one side corresponding to the lateral protrusion section, whereby when the push block is moved to the position of the lateral protrusion section, by means of the elastic force of the pressing leaf spring, the arched face abutting against the trough section and being located therein.

5. The connector structure as claimed in claim 3, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

6. The connector structure as claimed in claim 3, wherein the conductive section is at least one of a conductive socket and a conductive pin.

7. The connector structure as claimed in claim 6, wherein a lateral protrusion section is disposed on one side of the abutment end and extends out of the receiving space, the lateral protrusion section having an arched face raised toward the push block, the push block having a trough section on one side corresponding to the lateral protrusion section, whereby when the push block is moved to the position of the lateral protrusion section, by means of the elastic force of the pressing leaf spring, the arched face abutting against the trough section and being located therein.

8. The connector structure as claimed in claim 6, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

9. The connector structure as claimed in claim 6, wherein the receiving space has an opening, two lateral notches being respectively disposed on two sides of the opening, a locating hollow being disposed in one side of the receiving space in adjacency to the conductive section, two lateral recesses being respectively disposed on two sides of the locating hollow, the pressing leaf spring having a fixed end distal from the abutment end, two outward protruding lateral protrusions being disposed on two sides of the fixed end, a lateral rib being disposed at the middle of each of two sides of the pressing leaf spring, the fixed end being inserted in the locating hollow of the wire connection member and the two lateral protrusions being inserted in the lateral recesses, the lateral ribs being cooperatively engaged in the lateral notches, whereby the pressing leaf spring is located in the receiving space and the abutment end obliquely extends in a direction away from the opening.

10. The connector structure as claimed in claim 9, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

11. The connector structure as claimed in claim 1, wherein the receiving space has an opening, two lateral notches being respectively disposed on two sides of the opening, a locating hollow being disposed in one side of the receiving space in adjacency to the conductive section, two lateral recesses being respectively disposed on two sides of the locating hollow, the pressing leaf spring having a fixed end distal from the abutment end, two outward protruding lateral protrusions being disposed on two sides of the fixed end, a lateral rib being disposed at the middle of each of two sides of the pressing leaf spring, the fixed end being inserted in the locating hollow of the wire connection member and the two lateral protrusions being inserted in the lateral recesses, the lateral ribs being cooperatively engaged in the lateral notches, whereby the pressing leaf spring is located in the receiving space and the abutment end obliquely extends in a direction away from the opening.

12. The connector structure as claimed in claim 11, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

13. The connector structure as claimed in claim 11, wherein an elastic member is disposed in each channel beside the push block to abut against the push block, the push member having a protrusion pin section inserted in the elastic member and located therein.

14. The connector structure as claimed in claim 3, wherein the receiving space has an opening, two lateral notches being respectively disposed on two sides of the opening, a locating hollow being disposed in one side of the receiving space in adjacency to the conductive section, two lateral recesses being respectively disposed on two sides of the locating hollow, the pressing leaf spring having a fixed end distal from the abutment end, two outward protruding lateral protrusions being disposed on two sides of the fixed end, a lateral rib being disposed at the middle of each of two sides of the pressing leaf spring, the fixed end being inserted in the locating hollow of the wire connection member and the two lateral protrusions being inserted in the lateral recesses, the lateral ribs being cooperatively engaged in the lateral notches, whereby the pressing leaf spring is located in the receiving space and the abutment end obliquely extends in a direction away from the opening.

15. The connector structure as claimed in claim 14, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

16. The connector structure as claimed in claim 9, wherein a lateral protrusion section is disposed on one side of the abutment end and extends out of the receiving space, the lateral protrusion section having an arched face raised toward the push block, the push block having a trough section on one side corresponding to the lateral protrusion section, whereby when the push block is moved to the position of the lateral protrusion section, by means of the elastic force of the pressing leaf spring, the arched face abutting against the trough section and being located therein.

17. The connector structure as claimed in claim 16, wherein an elastic member is disposed in each channel beside the push block to abut against the push block, the push member having a protrusion pin section inserted in the elastic member and located therein.

18. A connector structure comprising a case seat assembly, a plug assembly, a pressing leaf spring and an unlocking assembly, at least one axially extending channel being formed on a circumference of an end section of the case seat assembly, the plug assembly having a conductive section and a wire connection member electrically connected with each other, a receiving space being disposed at one end of the wire connection member distal from the conductive section, the pressing leaf spring being disposed in the receiving space, one end of the pressing leaf spring being formed with an abutment end obliquely extending in the receiving space for abutting against a conductive wire extending into the receiving space, the unlocking assembly being disposed beside the wire connection member, the unlocking assembly having a push member partially protruding out of the channel, the push member being formed with a push block directed to the interior of the channel, a part of the pressing leaf spring being right positioned in a sliding path of the push block along the channel, whereby the part of the pressing leaf spring can be pushed by the push block to drive the abutment end to release the conductive wire;

wherein a lateral protrusion section is disposed on one side of the abutment end and extends out of the receiving space, the lateral protrusion section having an arched face raised toward the push block, the push block having a trough section on one side corresponding to the lateral protrusion section, whereby when the push block is moved to the position of the lateral protrusion section, by means of the elastic force of the pressing leaf spring, the arched face abutting against the trough section and being located therein.

19. The connector structure as claimed in claim 18, wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

20. The connector structure as claimed in claim 18, wherein an elastic member is disposed in each channel beside the push block to abut against the push block, the push member having a protrusion pin section inserted in the elastic member and located therein.

21. A connector structure comprising a case seat assembly, a plug assembly, a pressing leaf spring and an unlocking assembly, at least one axially extending channel being formed on a circumference of an end section of the case seat assembly, the plug assembly having a conductive section and a wire connection member electrically connected with each other, a receiving space being disposed at one end of the wire connection member distal from the conductive section, the pressing leaf spring being disposed in the receiving space, one end of the pressing leaf spring being formed with an abutment end obliquely extending in the receiving space for abutting against a conductive wire extending into the receiving space, the unlocking assembly being disposed beside the wire connection member, the unlocking assembly having a push member partially protruding out of the channel, the push member being formed with a push block directed to the interior of the channel, a part of the pressing leaf spring being right positioned in a sliding path of the push block along the channel, whereby the part of the pressing leaf spring can be pushed by the push block to drive the abutment end to release the conductive wire;

wherein the case seat assembly includes a first case seat and a second case seat connected with each other, the channels being formed on outer circumference of the first case seat, a cavity and an end recess being respectively formed on two end faces of the second case seat, the end recess being directed to the first case seat and communicating with the channels, multiple passages being formed between the cavity and the end recess, the conductive sections being disposed in the passages, one end of the conductive section extending into the cavity.

22. The connector structure as claimed in claim 21, wherein an elastic member is disposed in each channel beside the push block to abut against the push block, the push member having a protrusion pin section inserted in the elastic member and located therein.

23. The connector structure as claimed in claim 21, wherein multiple stop sections are disposed at one end of the first case seat distal from the second case seat and extend into the channels respectively so as to limit the sliding range of the push block within the channel, each of the stop sections being formed with a wire socket and a notch corresponding to the channel, the wire socket being for the conductive wire to extend into the channel from outer side, a flat tool being usable to pass through the notch from outer side to push the push block to move.

24. The connector structure as claimed in claim 23, wherein a protrusion section is disposed at one end of the second case seat distal from the cavity beside each passage, the protrusion section being inserted into one end of the reception hole distal from the wire connection member, a protruding press section being disposed at a center of the first case seat, the press section serving to press an end face of each conductive section in adjacency to the wire connection member, whereby the conductive section can be securely located in the passage.

25. The connector structure as claimed in claim 21, wherein multiple lateral sink sections are formed on an end face of the second case seat in adjacency to the first case seat, a locating dent being formed in each lateral sink section, multiple lateral protrusion sections being formed on an end face of the first case seat in adjacency to the second case seat corresponding to the lateral sink sections, a locating key being disposed on each lateral protrusion section, whereby the lateral protrusion section can be inserted into the corresponding lateral sink section with the locating key inserted in the locating dent so as to securely connect the first and second case seats with each other.

26. The connector structure as claimed in claim 25, wherein a protrusion section is disposed at one end of the second case seat distal from the cavity beside each passage, the protrusion section being inserted into one end of the reception hole distal from the wire connection member, a protruding press section being disposed at a center of the first case seat, the press section serving to press an end face of each conductive section in adjacency to the wire connection member, whereby the conductive section can be securely located in the passage.

27. The connector structure as claimed in claim 25, wherein an elastic member is disposed in each channel beside the push block to abut against the push block, the push member having a protrusion pin section inserted in the elastic member and located therein.

28. The connector structure as claimed in claim 23, wherein multiple lateral sink sections are formed on an end face of the second case seat in adjacency to the first case seat, a locating dent being formed in each lateral sink section, multiple lateral protrusion sections being formed on an end face of the first case seat in adjacency to the second case seat corresponding to the lateral sink sections, a locating key being disposed on each lateral protrusion section, whereby the lateral protrusion section can be inserted into the corresponding lateral sink section with the locating key inserted in the locating dent so as to securely connect the first and second case seats with each other.

29. The connector structure as claimed in claim 28, wherein a protrusion section is disposed at one end of the second case seat distal from the cavity beside each passage, the protrusion section being inserted into one end of the reception hole distal from the wire connection member, a protruding press section being disposed at a center of the first case seat, the press section serving to press an end face of each conductive section in adjacency to the wire connection member, whereby the conductive section can be securely located in the passage.

30. The connector structure as claimed in claim 21, wherein a protrusion section is disposed at one end of the second case seat distal from the cavity beside each passage, the protrusion section being inserted into one end of the reception hole distal from the wire connection member, a protruding press section being disposed at a center of the first case seat, the press section serving to press an end face of each conductive section in adjacency to the wire connection member, whereby the conductive section can be securely located in the passage.

31. The connector structure as claimed in claim 30, wherein an elastic member is disposed in each channel beside the push block to abut against the push block, the push member having a protrusion pin section inserted in the elastic member and located therein.

* * * * *